US005540518A

United States Patent [19]

Wambold

[11] Patent Number: 5,540,518

[45] Date of Patent: Jul. 30, 1996

[54] METHOD AND APPARATUS FOR CONTROLLING STRIPING EQUIPMENT

[75] Inventor: James C. Wambold, State College, Pa.

[73] Assignee: Linear Dynamics Inc., Pa.

[21] Appl. No.: 128,216

[22] Filed: Sep. 29, 1993

[51] Int. Cl.[6] ..... E01C 23/16

[52] U.S. Cl. ..... 404/84.05; 404/94

[58] Field of Search ..... 118/669; 404/83, 404/84.05, 93, 94, 111; 427/136, 137; 239/69, 70, 71, 73, 74; 222/646, 71, 64, 23, 25; 137/624.11, 624.13, 624.15

[56] References Cited

U.S. PATENT DOCUMENTS

| | | | |
|---|---|---|---|
| 3,836,078 | 9/1974 | Olson et al. | 239/70 |
| 4,473,319 | 9/1984 | Spangler | 404/84.05 X |
| 4,570,385 | 2/1986 | Richter et al. | 51/165.71 |
| 4,854,769 | 8/1989 | Fukukawa et al. | 404/72 |
| 5,139,044 | 8/1992 | Otten et al. | 239/69 X |
| 5,173,855 | 12/1992 | Nielsen et al. | 239/69 X |
| 5,195,043 | 3/1993 | Varner | 239/69 X |
| 5,203,923 | 4/1993 | Hartman | 404/93 X |
| 5,315,503 | 5/1994 | Kato et al. | 364/192 |

*Primary Examiner*—Ramon S. Britts
*Assistant Examiner*—James A. Lisehora
*Attorney, Agent, or Firm*—Cushman Darby & Cushman, LLP

[57] ABSTRACT

A method and apparatus for controlling striping equipment mounted on a vehicle includes a controller. The controller receives signals from a distance measuring device and various sensors. The controller also receives operator input via a console having operator controls. Based on the operator input, the controller determines striping commands which instruct the controller to cause the striping equipment to paint a painting pattern. The controller generates a striping program during a striping operation by saving the striping commands as a function of the measured distance. Using a previously saved striping program, the controller can cause the repainting of a previous striping operation. The controller also monitors striping operational data as a function of the distance travelled, and performs diagnostic functions to determine malfunction of the striping control system and the controller itself.

12 Claims, 10 Drawing Sheets

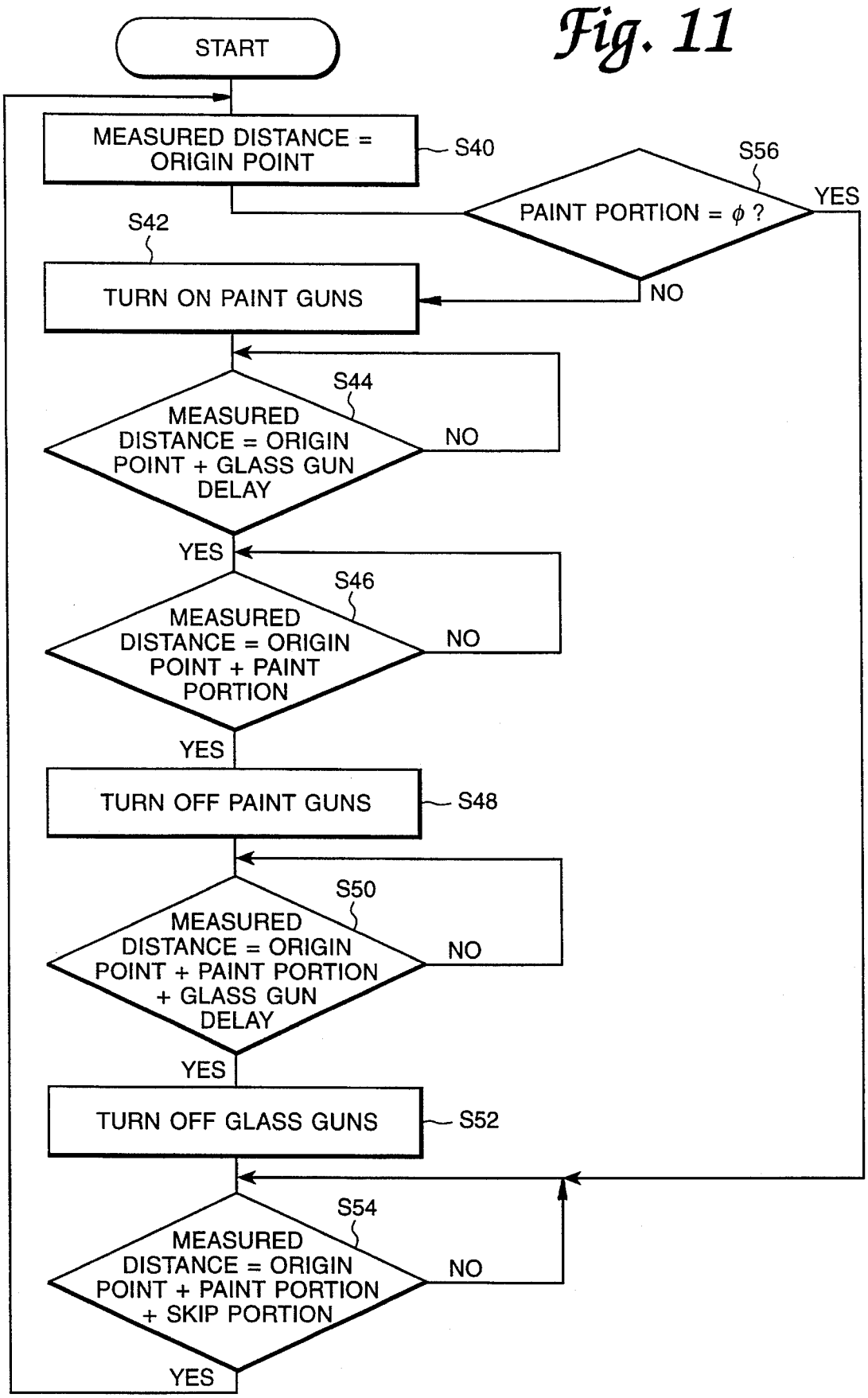
Fig. 11
START
MEASURED DISTANCE = ORIGIN POINT
S40
S56
PAINT PORTION = φ ?
YES
NO
S42
TURN ON PAINT GUNS
S44
MEASURED DISTANCE = ORIGIN POINT + GLASS GUN DELAY
NO
YES
S46
MEASURED DISTANCE = ORIGIN POINT + PAINT PORTION
NO
YES
TURN OFF PAINT GUNS
S48
S50
MEASURED DISTANCE = ORIGIN POINT + PAINT PORTION + GLASS GUN DELAY
NO
YES
TURN OFF GLASS GUNS
S52
S54
MEASURED DISTANCE = ORIGIN POINT + PAINT PORTION + SKIP PORTION
NO
YES

METHOD AND APPARATUS FOR CONTROLLING STRIPING EQUIPMENT

BACKGROUND OF THE INVENTION

1. Field of the Invention

The present invention relates to a control system for controlling striping equipment mounted on a vehicle.

2. Description of Related Art

Initially the striping or painting of paved roads was performed by hand. Today most road painting is performed from a vehicle at slow speeds. The vehicle pulls a trailer With the striping equipment, or the striping equipment is placed on the flat bed of a truck.

FIGS. 2, 3A and 3B show the typical layout of striping equipment mounted on the flatbed of a truck. Five controllers are primarily used to control striping equipment, such as shown in FIGS. 2, 3A and 3B, in the United States today. Those controllers include: LDI model 3SE-88, made by ECCI Micro-Wiz; Skipline Electronics model MS-88, made by Skipline Electronics; Research Derivatives model 304, made by Research Derivatives; MB model MB-3000, made by MCS-51 Series Micro Controller; Linetech Model Micro-Skip KD-1, made by Linetech. FIG. 1 is a block diagram representative of these conventional striping equipment controllers.

FIGS. 3A and 3B illustrate a top and left side view of a truck 10 carrying striping equipment. As shown in FIGS. 3A and 3B the striping equipment includes both paint tanks 100 and glass bead tank 102 for supplying striping material (paint and glass beads) to a left and right matrix of striping guns 140 and 142. The guns are mounted on a left carriage 106 and a right carriage 108, respectively. Striping guns 140 can be paint or glass bead dispensing guns.

FIG. 2 illustrates that the left carriage 106 and the right carriage 108 can be positioned near the rear of the vehicle 10 or a left carriage 106' and right carriage 108' can be positioned near the front of the vehicle 10. Alternatively, the left carriage 106 and right carriage 108 can be combined into a single carriage and disposed as a rear carriage 110 or a front carriage 112.

The left carriage supports a matrix of paint and glass bead guns 140 and the right carriage supports a matrix of paint and glass guns 142 shown in FIG. 2. Each matrix consists of one or more gun lines arranged across the width of the vehicle and perpendicular to the direction of the striping equipment vehicle's travel. Each gun line consists of a row of guns in the direction of and parallel to the vehicle's travel. The paint guns are arranged in front of the glass guns so that glass beads dispensed from the glass guns are dispensed onto freshly painted portions of the roadway. The dispensing of glass beads by the glass guns is also delayed by a predetermined amount dependent on the distance between the paint and glass guns. The delay ensures that the dispensing of the glass beads matches the dispensing of paint so that glass beads are dispensed onto freshly painted portions of the roadway and not unpainted portions of the roadway. An operator sets the delay, usually in terms of distance, using controller 124 shown in FIG. 1. Therefore, the glass guns are activated only after the vehicle 10 has travelled an operator-programmed distance after the activation of the paint guns. Glass beads applied to painted portions reflect light and make the painted portions more visible. The application of glass beads in conventional systems, as with the present invention, is optional.

Typically, either thermoplastic or paint are used to stripe roadways. Throughout the specification and the claims, the use of the word "paint" should be construed to cover both thermoplastic, paint, and any other material used to apply to a roadway. The use of the terminology "striping material" will refer to thermoplastic, paint, glass beads, and any other material used to apply to a roadway. Furthermore, the use of the terminology "painting" and "striping" are interchangeable, and "striping guns" refers to both paint guns and glass guns.

Typically, roads are striped using white and/or yellow paint. Occasionally, black paint is also used. Each gun in a gun line dispenses either paint of a certain color or glass beads. Depending on the requirements of the painting operation, only certain ones of the guns in a gun line are activated.

FIG. 2 illustrates the color and glass bead designations for the guns in one gun line of the left matrix of guns 140. FIG. 2 depicts three gun lines with five guns per gun line, however, the number of gun lines and the number of guns in a gun line can be increased or decreased with more than one gun dispensing the same color or glass beads.

FIG. 1 is a block diagram of a conventional striping control system which includes a distance measuring device 114, left control box 116, right control box 118, a counter box 120 housing counters 122, junction box 126, and controller 124 for controlling the left matrix and right matrix of striping guns 140, 142.

In the embodiment of the conventional striping control system of FIG. 1, the distance measuring device 114 is illustrated as a pulse generator. The pulse generator generates pulses in relation to the rotation of a wheel of the vehicle 10, a fifth (extra) wheel, the transmission, etc. and outputs pulse signals representing the distance traveled.

The left control box 116 and right control box 118 output control signals for controlling the left matrix of paint and glass guns 140 and the right matrix of paint and glass guns 142, respectfully. Specifically, the control signals turn on or turn off a paint or glass gun. Typically the turning on or off of a paint or glass gun is performed by energizing or de-energizing a solenoid.

The left control box 116 includes an auto/manual switch 130, skip/solid switch 128, and a remote control 144. The auto/manual switch can be set in either an auto setting or a manual setting. The skip/solid switch 128 can be set in either a skip setting, an off setting or a solid setting. Although FIG. 1 only depicts a single skip/solid switch 128, for simplicity of illustration, left control box 116 will have a skip/solid switch 128 for each gun line in the left matrix of guns 140.

When the auto/manual switch 130 is in the auto setting and an operator places the skip/solid switch 128 in the skip setting, the left control box 116 outputs a control signal to controller 124 via junction box 126. The controller 124 then sends control signals to the paint and glass guns corresponding to the skip/solid switch 128, to paint a cycle stored in controller 124.

FIG. 4 illustrates the concepts of cycle, cycle length, paint portion, and skip portion. Each cycle has a paint portion and a skip portion. The paint portion is the distance over which paint is applied, and the skip portion is the distance over which no paint is applied. The cycle length is the length of one paint portion and associated skip portion which will be repeated as a cycle. The term "skipline" refers to the continuous and consecutive repetition of a cycle. All the cycles, blank lines, or solid lines being painted by a matrix of striping guns is referred to a painting or striping pattern.

When in the auto setting and the operator places the skip/solid switch 128 in the off setting, the paint and glass guns corresponding to the skip/solid switch 128 cease painting the cycle. Upon switching the skip/solid switch 128 from the off setting to the skip setting, left control box 116 and controller 124 do not resume painting the cycle from the point where the painting of the cycle was interrupted. Instead, the left control box 116 and controller 124 control the paint and glass guns to begin painting the cycle from the beginning of the cycle. Therefore, operators cannot suspend a painting operation and simply resume the painting operation without considerable effort in realigning the vehicle 10 before resuming the painting operation. When in the auto setting and the operator places the skip/solid switch 128 in the solid setting, the left control box 116 outputs control signals to the paint and glass guns corresponding to the skip/solid switch 128 so that a solid line is painted.

When the auto/manual switch 130 is in the manual setting and an operator places the skip/solid switch 128 in the skip setting, the remote control 144 is activated. By depressing the push button 146 on remote control 144 an operator causes both the paint and glass guns corresponding to the skip/solid switches 128 set in the skip setting to dispense paint. The dispensing of glass beads by the glass guns, however, is not delayed to match the glass beads with the painted portion. Consequently, the glass guns dispense glass beads on unpainted portions of the roadway. The paint and glass guns dispensing paint and glass in response to the depression of push button 146 will dispense paint and glass beads as long as the operator maintains the push button 146 depressed. When the operator releases push button 146, the paint and glass guns cease dispensing paint and glass beads.

When in the manual setting and the operator places the skip/solid switch 128 in the off setting, the paint and glass guns corresponding to the skip/solid switch 128 cease painting. When in the manual setting and the operator places the skip/solid switch 128 in the solid setting, the left control box 116 outputs control signals to the paint and glass guns corresponding to the skip/solid switch 128 so that a solid line is painted.

The left control box 116 also includes a paint switch (not shown). By operating the paint switch, an operator can change the color of paint supplied to the paint guns of the left matrix of guns 140. Alternatively, a paint switch can be supplied for each gun line in the matrix of guns.

A description of the right control box 118 is omitted, since the right control box 118 is the same as left control box 116 except that the right paint and glass guns are controlled.

The counter box 120 includes counters 122 for measuring the footage of paint and glass used. As shown in FIG. 2, the counter box 120 can be disposed in the cab of the truck and/or in the rear of the truck. The counters 122 measure the footage (distance) of paint and glass used based on the output signals from the left control box 116, right control box 118, controller 124, and the distance measuring device 114. The counter 122, one counter per gun, can count the footage of paint and glass applied by each gun based on the distance each gun applied paint or glass during the striping operation.

Except for the control signals produced by the left control box 116 and right control box 118 when in the solid setting or off setting, controller 124 receives all control signals produced by the left control box 116, right control box 118, and distance measuring device 114 via junction box 126. The controller 124 includes a control panel 134 with control keys 136. By operating an appropriate control key, an operator can view on display 138 the vehicle speed, the time of day, the cycle length of the stored cycle, the length of the paint portion of the stored cycle and the distance travelled in feet. The controller 124 includes a reset control key which allows an operator to reset accumulated values such as the distance travelled in feet.

The control panel 134 also includes a set up control key, paint delay control keys, and a program key. The set up control key is used to calibrate distance measurement using distance measuring device 114. Upon depressing the set up control key, the operator drives vehicle 10 a fixed distance and again depresses the set up control key. The controller 124 counts the number of pulses received from distance measuring device while travelling the fixed distance. The controller 124 can now compute the distance travelled based on the pulses received over the fixed distance.

The paint delay control keys allow an operator to set the delay, in units of distance, from the point at which a paint gun turns on until a corresponding glass gun turns on. The program control key sets controller 124 in a programming mode. In the programming mode, an operator can enter a cycle. Programming a cycle consists of inputting, in units of distance, the paint portion and skip portion of the cycle. The conventional controllers can only store a single cycle. Therefore, to paint a different skipline, an operator must stop the painting operation and reprogram the cycle. To paint different skiplines using the left matrix of guns and right matrix of guns 140, 142 at the same time requires the use of two controllers. Each controller would have control over one of the left matrix and right matrix of guns 140, 142.

The controller 124 includes advance and retard control keys which allow an operator to advance or retard the cycle. FIGS. 5 and 6 illustrate the advance and retard cycle concepts. As shown in FIGS. 5 and 6, when the cycle is advanced or retarded, the cycle length remains the same. The beginning of the cycle, however, is either advanced by a predetermined amount, or retarded by a predetermined amount. This allows an operator to match the current striping of the roadway with previously striped portions assuming the cycle is the same.

Conventional control systems also receive signals from various sensors such as volume sensors (not shown) measuring the volume of paint and glass beads in the paint and glass bead supply tanks and temperature sensors (not shown) measuring the temperature of the paint applied. Conventional striping control systems monitor the total amount of paint applied, the total footage of paint applied, the temperature of the applied paint, the total footage of each color applied, and the pounds of glass used based on the output of the sensors and the distance measuring device 114. Based on the output from these sensors and the control signals sent to operate the paint and glass guns, the conventional striping control systems also monitor the footage of paint supplied per gun and the pounds of glass used per gun. The monitored information can also be printed.

When the signals from the paint and glass volume sensors indicate a volume below a predetermined value, conventional control systems are designed to issue either an audio or visual alarm.

Other than the advance and retard capability, conventional striping control systems do not aid in the repainting of a previously painted roadway. Operators of conventional striping control systems must repeat the same control operations as when the roadway was originally painted.

Furthermore, these conventional striping control systems do not allow for correction of the cycle length or the paint portion of a cycle. Instead, each change or adjustment of the cycle length or paint portion of a cycle requires an operator to reprogram the cycle in the controller.

The monitoring functions performed by conventional striping control systems provide the opportunity for operators to "cheat" in the painting operation. Since only the total footage of paint and glass are monitored, an operator can skimp on the amount of paint used in the painting operation. The total footage of paint applied would be the same as if the operator had applied the appropriate amount of paint during the entire painting operation. The operator, thus, saves money in terms of the amount of paint applied, but the roadway receives an improperly low amount of paint.

Additionally, when breakdowns in the striping equipment or the striping control system itself occur, the conventional striping control systems do not include any means for determining which part has malfunctioned.

SUMMARY OF THE INVENTION

An object of the present invention is to provide a control system and method of controlling road striping equipment which learns a striping operation. A further object of the present invention is for the control system and method of the present invention to be able to control a painting operation based on the learned striping operation.

The control system and method of the present invention achieves this objective by providing a controller which stores the cycles painted by each striping gun as a function of distance. The controller of the present invention can then input this striping program and control the painting operation based thereon whenever necessary. The controller monitors the distance travelled, and when the distance travelled reaches a value pre-stored in the striping program, the controller outputs to the striping guns the cycles in the striping program corresponding to the stored distance.

Another object of the present invention is to provide a control system and method which causes a matrix of striping guns to paint a painting pattern in response to simple operator input.

The control system and method of the present invention achieves this objective by providing painting pattern command keys for both a left matrix and right matrix of guns. Each painting pattern command key corresponds to a different painting pattern. A controller of the present invention causes the painting of the painting pattern corresponding to a painting pattern command key in response to activation of the painting pattern command key.

A further object of the present invention is to provide for control of the cycles painted during a painting operation.

The control system and method of the present invention achieves this objective by providing command keys for both a left matrix and right matrix of guns. One set of command keys causes a cycle to be advanced and retarded as in conventional control systems. The control system and method of the present invention also provides positive and negative command keys which allow the cycle length to be increased or decreased by increasing or decreasing the paint portion of the cycle in response to activation of the positive and negative commands keys, respectively.

Alternatively, the cycle length can be increased or decreased by increasing or decreasing the skip portion of the cycle in response to activation of the positive and negative commands keys, respectively.

Alternatively, the paint portion of the cycle can be increased or decreased while maintaining the cycle length the same in response to activation of the positive and negative commands keys, respectively.

Another object of the present invention is to provide a control system and method which allows an operator to control the striping equipment through the use of the above described command keys, conventional switches, or a combination of both.

The control system and method of the present invention achieves this objective by allowing an operator to select the type of controls he wishes to use.

A further object of the present invention is to provide a control system and method which allows an operator to chose whether to control the striping equipment using the controls provided by the control system of the present invention or to control the striping operation using a previously generated striping program.

The control system and method of the present invention achieves this objective by providing a selecting means for selecting between control of the striping equipment using the controls provided by the control system of the present invention or control based on a previously generated striping program.

Another objective of the present invention is to provide a control system and method which can diagnose malfunctions of the control system.

The control system and method of the present invention achieves this objective by providing an I/O isolator which receives control signals output by the controller of the present invention. The I/O isolator includes indicators which indicate the receipt of control signals from the controller. The I/O isolator also outputs the control signals to the appropriate striping guns. The control system and method of the present invention further provides indicators which indicate receipt of a control signal by a striping gun. By monitoring the indicators, an operator can diagnose control system malfunctions.

Furthermore, the method and apparatus of the present invention provides a jumper for connecting the inputs of the controller to the outputs of the controller. Whether the controller is malfunctioning can be determined by whether test signals output on the controller's outputs are received by the inputs connected thereto.

An additional objective of the control system and method of the present invention is to monitor various painting operation data as a function of distance.

The control system and method of the present invention achieves this objective by providing a controller which saves painting operation data at a predetermined distance interval and the corresponding measured distance. Since, the painting operation data is saved at a predetermined distance interval along with the measured distance, operator "cheating" can be discovered.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

FIG. 11 is a flow chart of the operation of the controller of the present invention when controlling the paint and glass guns.

DETAILED DESCRIPTION ON THE PREFERRED EMBODIMENT

Figure 7:
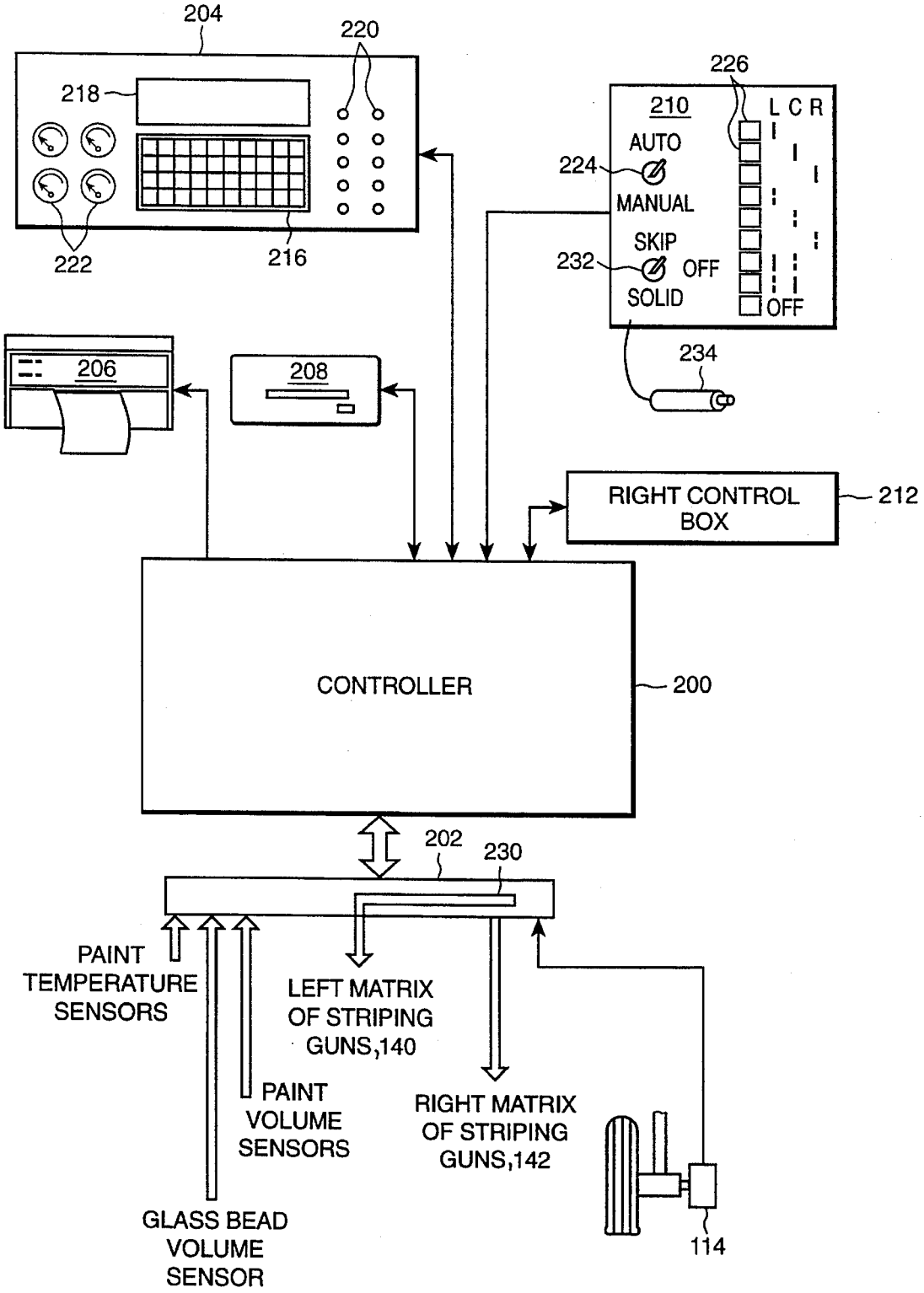
FIG. 7 is a block diagram representing the striping control system of the present invention.

FIG. 7 is a block diagram representing the striping control system of the present invention. The control system of the present invention can be used to control the above-described conventional striping equipment and modifications thereof.

The striping control system of the present invention includes a controller 200 which receives output signals from temperature sensors (not shown) measuring the temperature of paint applied, volume sensors (not shown) measuring the volume of paint in the paint tanks, volume sensor (not shown) measuring the volume of glass beads in the glass bead tank, and distance measuring device 114 via optical I/O isolator 202. The controller 200 also outputs control signals via optical I/O isolator 202 to the left matrix 140 and right matrix 142 of paint and glass guns. The controller 200 receives data from keyboard/display console 204 (hereinafter "console 204") entered by an operator via keyboard 216, and outputs information to the operator via display 218, indicators 220, and gauges 222. The controller 200 can display the temperature and/or volume data supplied by the paint temperature sensors, paint volume sensors, and glass bead volume sensors on gauges 222. The controller 200 outputs data for printing to printer 206, and outputs data for storage to external storage device 208.

The controller 200 receives signals from left control box 210, right control box 212, and console 204. As shown in FIG. 7, left control box 210 includes operator controls similar to a conventional control box. Unlike the conventional control boxes, all signals output from left control box 210 are output to controller 200. The controller 200 then outputs control signals via optical I/O isolator 202 to turn the appropriate paint and glass guns on and off.

The skip/solid switch 232, however, operates in a similar fashion to skip/solid switch 128. The difference between skip/solid switch 232 of the present invention and the conventional skip/solid switch 128 occurs when skip/solid switch 232 is placed in the off setting and when use is made of remote control 234. When using remote control 234, both the paint and glass guns are turned on and off. The controller 200 delays the point at which the glass guns turn on and off by a set distance to match the dispensing of glass beads with the freshly striped roadway. The left control box 210 allows operator manipulation of the skip/solid switch 232 when the auto/manual switch 224 is placed in the manual setting. The auto/manual switch 224 differs from auto/manual switch 130 of conventional control boxes when placed in the auto setting. When an operator places auto/manual switch 224 in the auto setting, painting pattern command keys 226 become active.

In the embodiment of the control system shown in FIG. 7, the left matrix of guns 140 and the right matrix of guns 142 each include three gun lines. It is to be understood that the number of gun lines is not limited to three, but can be greater or less than three. When an operator activates a painting pattern command key 226, the left (L), center (C) and right (R) gun lines are controlled to apply paint and produce a painting pattern. For an operators benefit, the painting patterns produced by a painting pattern command key can be illustrated to the side of the painting pattern command key as shown on left control box 210 of FIG. 7. The control of the paint and glass guns based on command key activation is described in detail below. A description of the right control box 212 is omitted as its operation is similar to that of the left control box 210 except that the right matrix of guns 142 is controlled.

Figure 8:
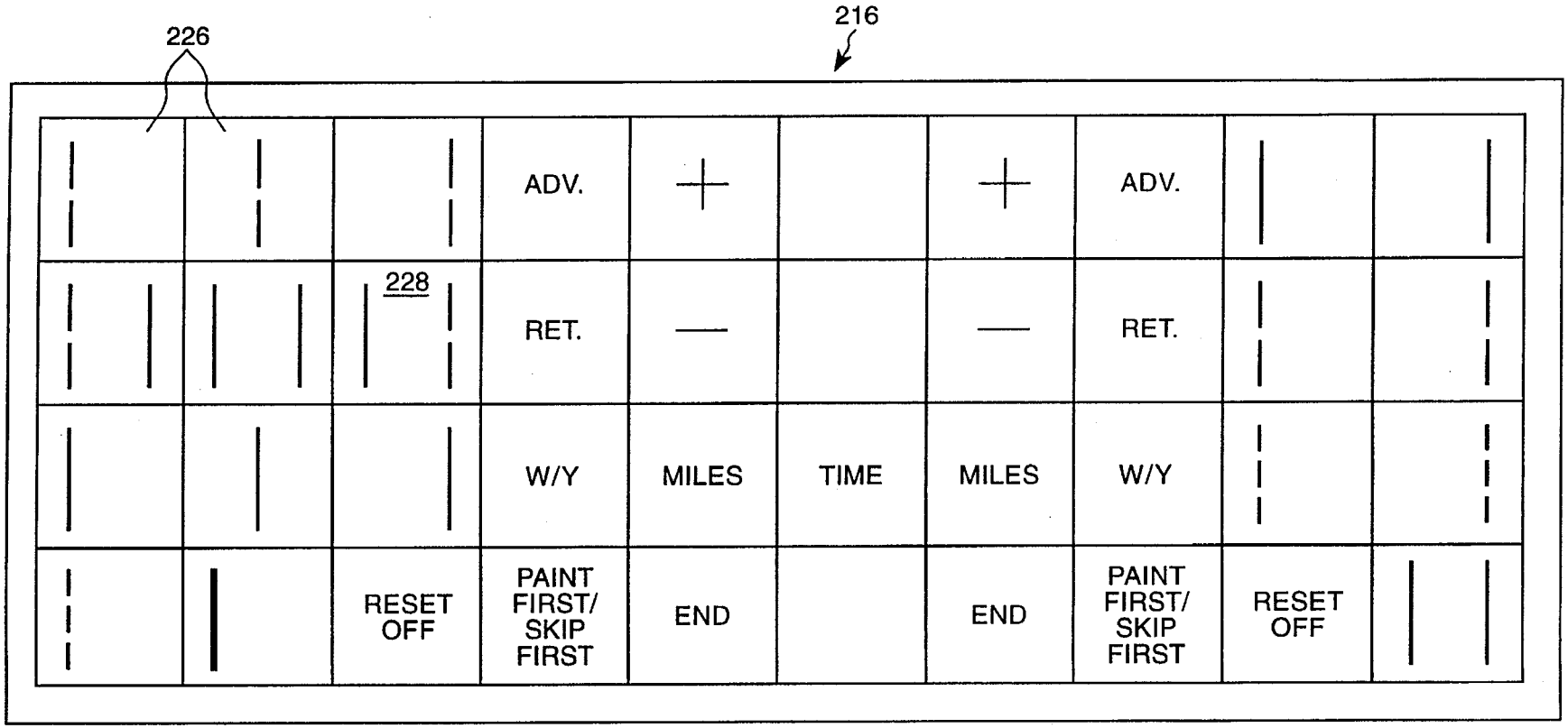
FIG. 8 is a detailed illustration of the of the present invention.

FIG. 8 illustrates keyboard 216 in detail. The keyboard 216 includes painting pattern command keys 226. The keyboard 216 is symmetrical with the painting pattern command keys 226 on the left side of keyboard 216 controlling operation of the left matrix of guns 140 and painting pattern command keys 226 on the right side of keyboard 216 controlling the right matrix of guns 142. As will be discussed in further detail below, the operation of console 204 renders redundant the operations of left control box 210 and right control box 212. Therefore, it is to be understood that use of or inclusion of a left control box 210 and right control box 212 within the striping control system of the present invention is optional. As further shown in FIG. 8, keyboard 216 includes a variety of other command keys which are described in detail below. Although not shown in FIG. 8, each of the depicted command keys also doubles as a data entry key wherein each key is assigned an alpha-numeric character so that keyboard 216 can double as a conventional keyboard for data entry by an operator. Whether keyboard 216 is operating in a command key mode or alpha-numeric mode depends on the operation mode of the control system. The operation modes of the control system are described in detail below.

As described in more detail below, controller 200 saves an ongoing painting operation as a striping program in its resident memory. Upon completion of the striping operation, controller 200, at the user's request, can output the striping program to external storage device 208. Similarly, previously stored striping programs can be uploaded from external storage device 208 to controller 200 for use in performing a striping operation.

The controller 200 can monitor the following data during a striping operation and save the monitored data in its resident memory: (1) the footage of paint applied by each paint gun, (2) the pounds of glass applied by each glass gun, (3) the gallons of paint applied by each paint gun, (4) the footage of color applied by each paint gun, (5) the rate of application of monitored data (1)–(4), (6) the footage of paint applied by all paint guns, (7) the pounds of glass applied by all glass guns, (8) the gallons of paint applied by all paint guns, (9) the footage of color applied by all paint guns, (10) the rate of application of monitored data (6)–(9), (11) the amount of paint used from each paint tank, (12) the amount of paint remaining in each paint tank, (13) the amount of glass beads used from the glass bead tank, (14) the amount of glass beads remaining in the glass beads tank, and (15) the temperature of the paint applied. It is to be understood that monitored data (1)–(15) is not an exclusive list but can be expanded to suit a user's needs. The controller 200 monitors the monitored data as a function of distance. In other words, controller 200 stores the monitored data in its resident memory at a predetermined distance interval, and stores the distance travelled from the beginning of the painting operation at each interval along with the monitored data. The monitored data is determined based on the output of the paint volume sensors, the glass volume sensor, the paint temperature sensors, the distance measuring device 114 and the standard thickness of paint applied during a striping operation. When the painting operation is complete, controller 200 inquires whether the operator wants to print the monitored data out on printer 206 and/or download the monitored data to external storage device 208.

In a preferred embodiment, controller 200 is a High Speed Little Giant™ model LG-X-HS with I/O Expander board, model Digital 10E-DGL and the following hardware options: a 128K memory chip, Model No. SBC-M128; an A/D 12-bit option, model A/D-12; digital to analog converter, model LG-DAC; switching power supply, model SWT-PWR, an operational amplifier, model OP-AMP; and keypad LCD, model LG-LCD all supplied by Z-World Engineering.

The inventor chose to use the High Speed Little Giant™ controller because of the processing capabilities available in relation to the controller's cost. It is to be understood that the present invention is not limited to use of the High Speed Little Giant™, and that other controllers can be substituted therefor. Ignoring cost, commercial controllers, such as produced by Alan Bradely, provide greater processing capabilities. However, when marketing a product, cost can not be ignored, and therefor, the inventor prefers to use the High Speed Little Giant™.

In a preferred embodiment, external storage device 208 is a conventional external memory device utilizing a memory card. The external storage device, however, can be any type of storage device such as a hard drive or disk drive using floppy disks.

The operation of controller 200 will now be described.

After starting up, controller 200 displays a main menu on display 218 of console 204. The main menu allows an operator to choose one of four modes of operation: 1. Installation, 2. Startup Data, 3. Diagnostic, and 4. Painting Control.

Figure 9:
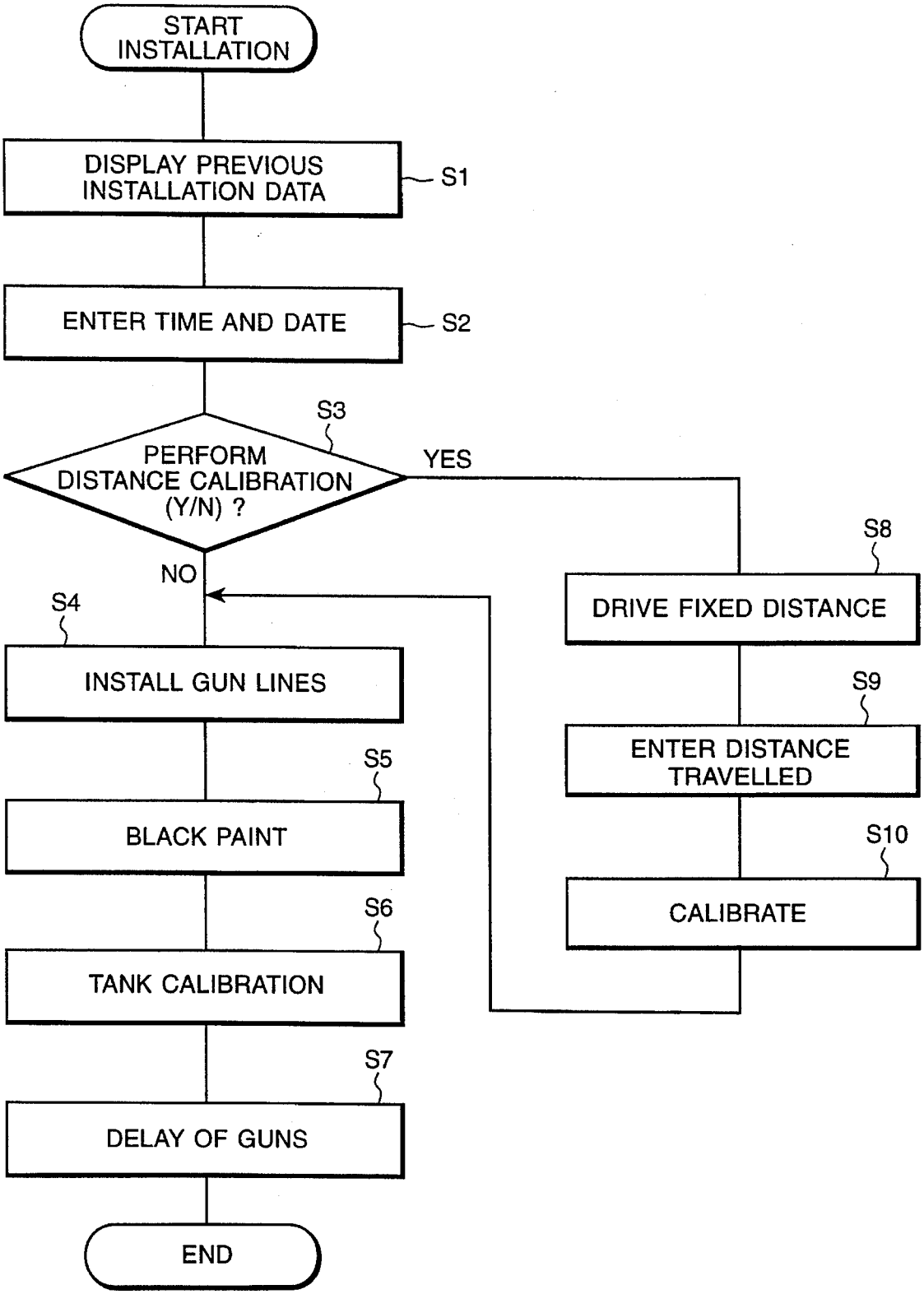
FIG. 9 is a flow chart of the Installation procedure of the present invention.

The Installation procedure is shown in FIG. 9. When installation begins, controller 200 displays the previous installation data on display 218 of console 204 in step S1 and provides the operator, during each step, the opportunity to maintain each data setting the same. Therefore, a description of this option for each data entry step will be omitted. During the installation procedure, controller 200 sets keyboard 216 in the alpha-numeric mode. The controller 200 then issues a request via display 218 for the operator to enter the time and date in step S2. In step S3, controller 200 via display 218 inquires of an operator whether to perform distance calibration. Depending on the type of distance measuring device used, the type of calibration can vary. For the embodiment of the present invention shown in FIG. 7, distance calibration is performed, as described with respect to convention control systems, by having an operator drive the vehicle a fixed distance in step S8. The operator then enters the distance travelled in step S9, and controller 200 calibrates the number of pulses received from distance measuring device 114 with the distance entered by the operator.

The installation process then proceeds to step S4 wherein controller 200 inquires which gun lines of the left matrix and right matrix of guns to install or recognize. In any given painting operation, the number of gun lines needed may vary. Additionally, since striping equipment varies, the number of gun lines tends to vary. Thus, the controller 200 needs to know which gun lines are available for use in the painting operation. In step S5 the controller 200 requests the operator to indicate whether black paint will be used.

The controller 200, in step S6, inquires whether to perform tank calibration. If the operator wishes to perform tank calibration, the controller 200 requests the operator to enter the volume of the yellow paint tank, white paint tank and glass bead tank. The controller 200 will also request entry of the volume of the black paint tank if use of black paint was indicated in step S5.

Figure 1:
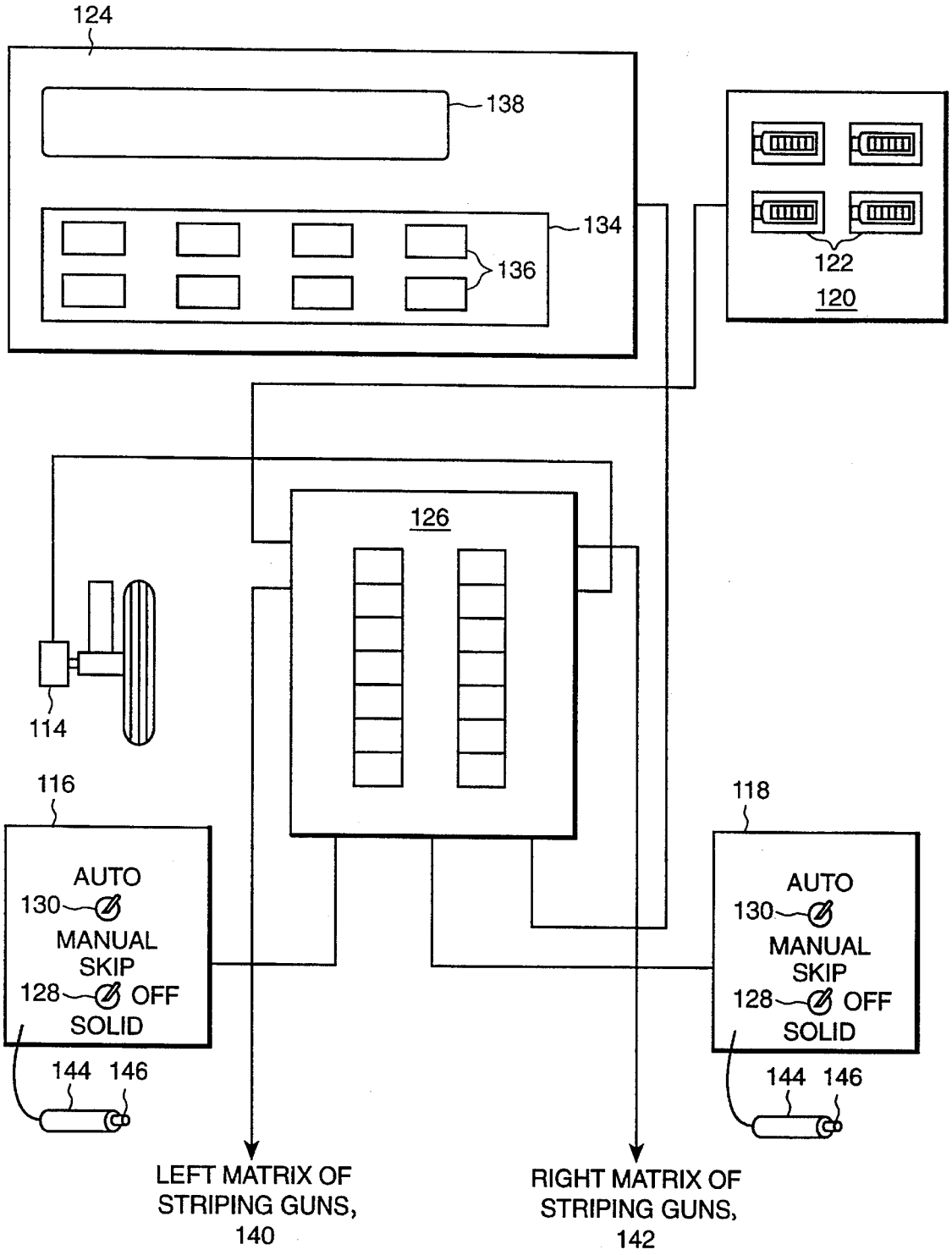
FIG. 1 is a block diagram representative of conventional striping equipment controllers.
Figure 2:
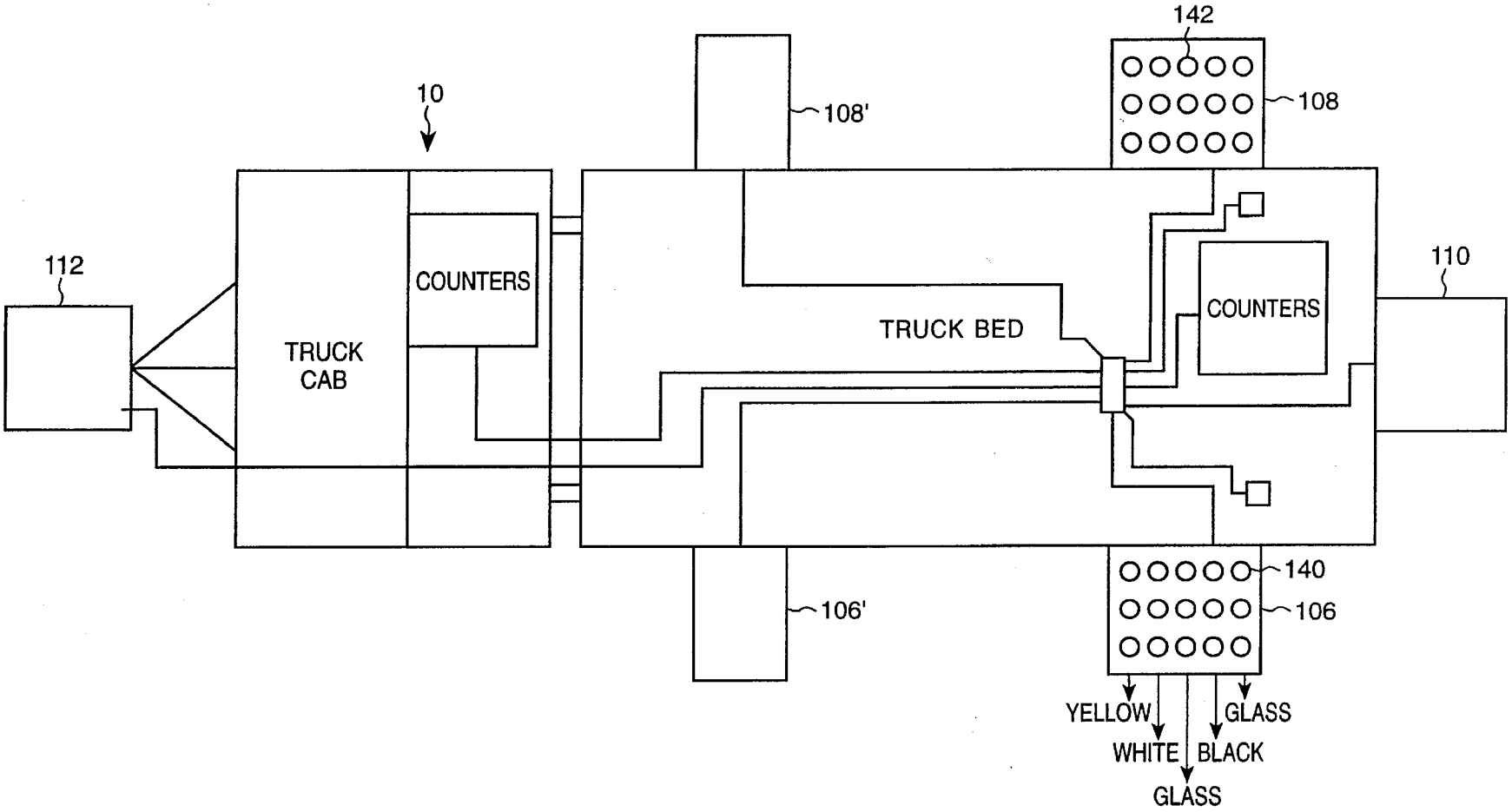
FIGS. 2, 3A and 3B show the typical layout of striping equipment mounted on the flatbed of a truck.
Figure 3A:
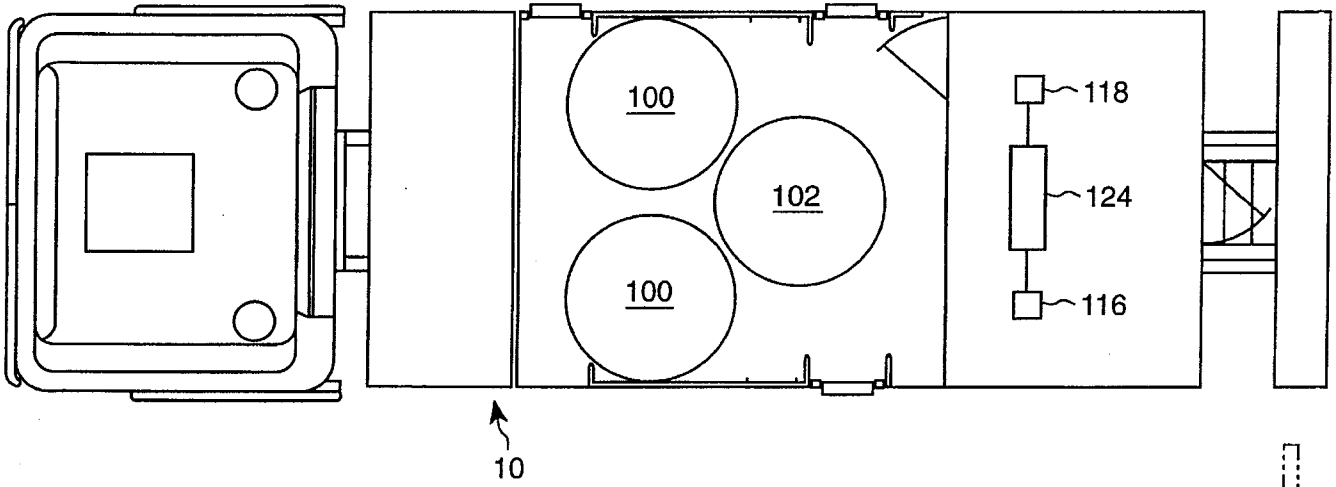
Figure 3B:
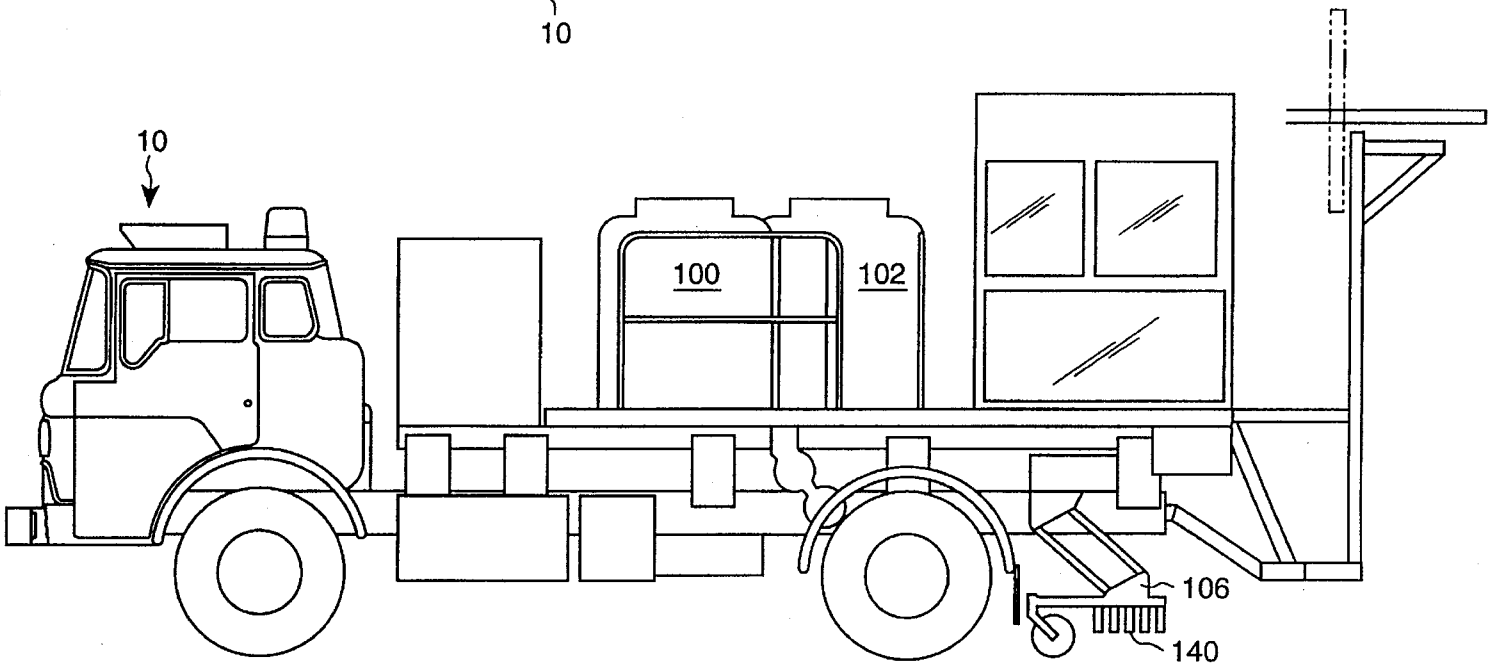
Figure 4:
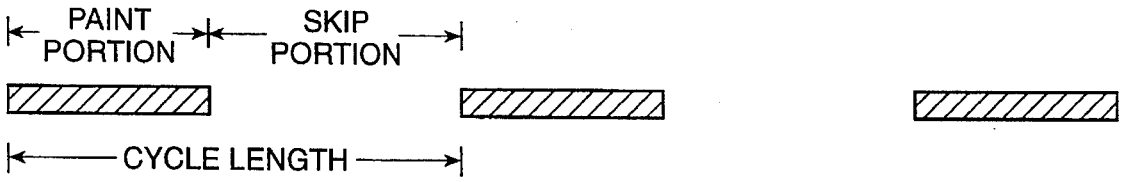
FIG. 4 illustrates the concepts of cycle, cycle length, paint portion, and skip portion.
Figure 5:
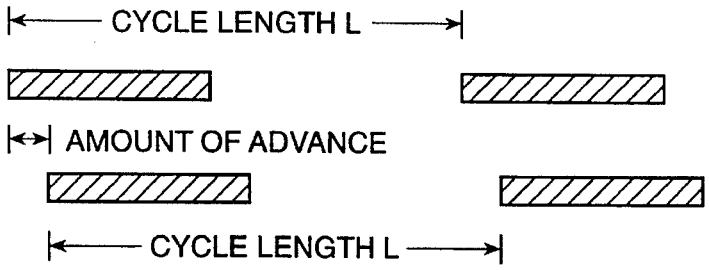
FIGS. 5 and 6 illustrate the advance and retard cycle concepts.
Figure 6:
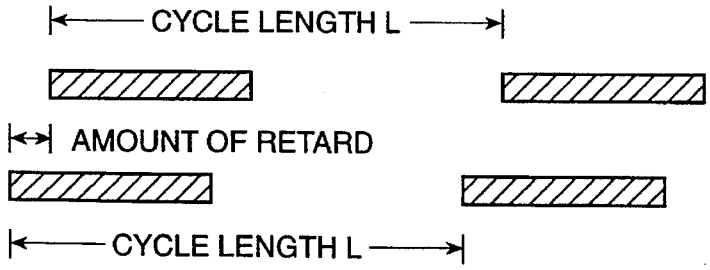

In step S7, controller 200 inquires whether the operator wants to set the delay of guns. Delay of guns is a distance measurement between the first gun and each consecutive gun in a gun line. If the operator chooses to set the delay of guns, controller 200 requests the distance between the first gun and each consecutive gun. The controller 200 uses the delay of guns, distance between guns, to delay the dispersement of paint and glass beads. As shown in FIG. 2, depending on which color is being dispensed, the distance between the paint dispensing gun and glass bead dispensing gun can change. Therefore, controller 200 needs to know the delay of guns in order to delay the dispensing of the glass beads by the appropriate distance so that the glass beads are applied to freshly painted roadway.

Generally, the installation procedure will not need to be performed as the striping equipment and the calibration settings will remain unchanged. The installation procedure, however, must be executed in the following cases: a new gun line is installed or an existing gun line removed, black painting installed or removed, new paint or glass bead tank installed, any changes in the distance measurement system, and rearrangement of guns in the gun line.

Next the Startup Data operation of controller 200 will be described. As with the installation operation, the operator has the option of maintaining each data setting the same. Therefore a description of this option for each data entry step will be omitted. As with the Installation procedure, controller 200 sets the keyboard 216 in the alpha-numeric mode during the Startup Data procedure.

Figure 10:
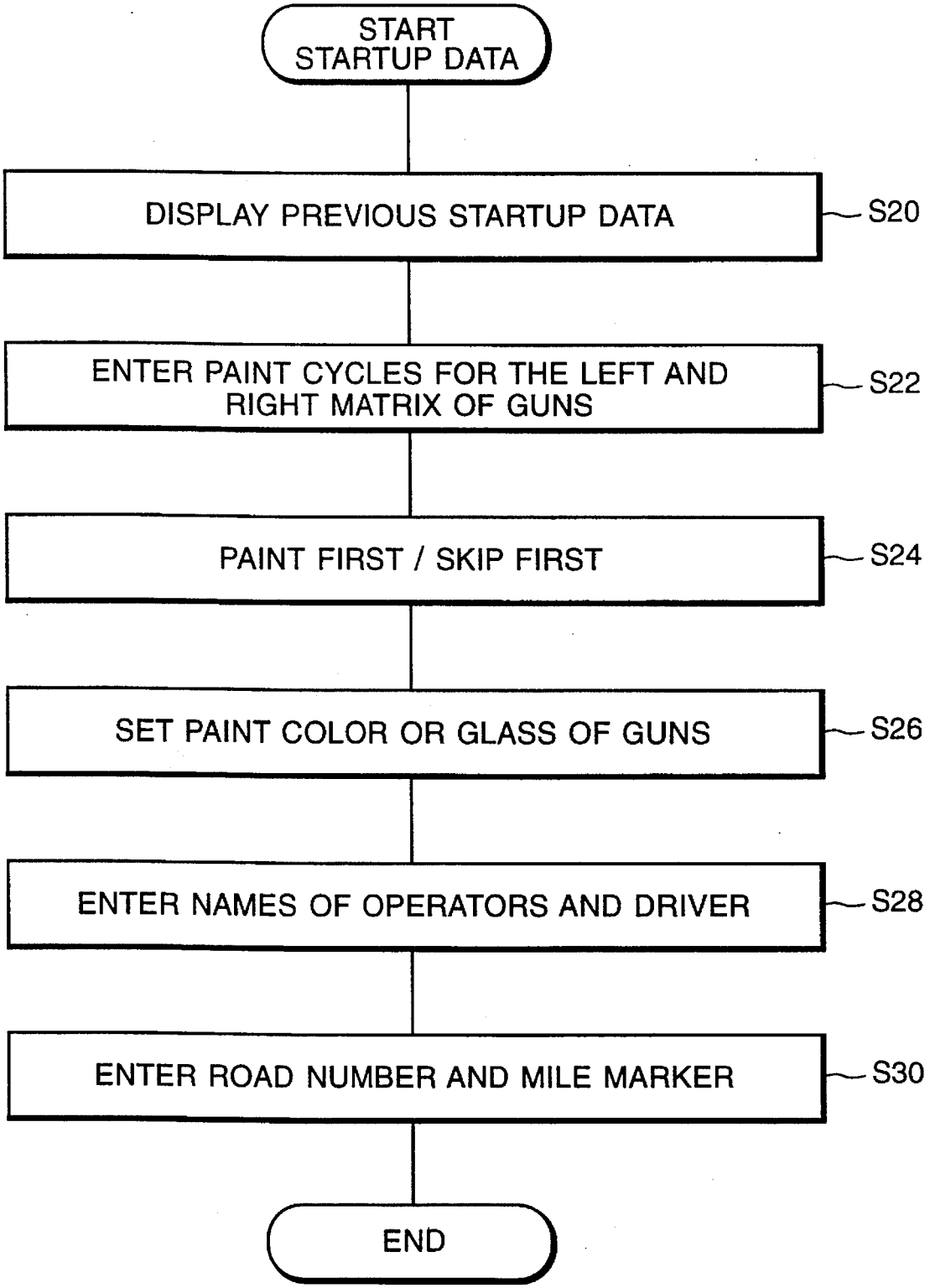
FIG. 10 is a flow chart of the Startup Data procedure of the present invention.

The Startup Data procedure will be described with respect to FIG. 10.

In step S20, controller 200 displays on display 218 the previous startup data. Operation then proceeds to step S22 wherein controller 200 issues a request, via display 218, for the operator to enter the paint cycles for the left matrix and right matrix of guns 140, 142. The controller 200 can store a number of different paint cycles for both the left matrix and right matrix of guns 140, 142. The number of paint cycles which controller 200 stores is dependent upon the amount of memory provided for controller 200. In the embodiment of the present invention, controller 200 permanently stores two types of cycles for both the left matrix and right matrix of guns 140, 142. The first permanent cycle has no skip portion (i.e. the painting portion is set at infinity); and thus, causes the painting of a solid line. The second permanent cycle does not have a paint portion; and thus, prevents any painting. In the embodiment of the present invention, controller 200 will accept two operator programmable cycles for both the left matrix and right matrix of guns 140, 142. It is to be understood, however, that the number of operator programmable cycles can be increased or decreased depending upon a user's requirements.

In step S22, controller 200 requests the operator to define the paint and skip portions of the first and second user programmable cycles for the left matrix of guns 140. After receiving the data from the operator via keyboard 216, controller 200 then requests the operator to enter the paint and skip portions for the first and second operator programmable cycles for the right matrix of guns 142.

After receiving the paint cycle data from the operator, controller 200 proceeds to step S24 and requests the operator to designate whether to cause the left matrix of guns 140 to begin painting cycles with the paint portion first or the skip portion first. The controller 200 then requests the operator to designate whether to cause the right matrix of guns 142 to begin painting cycles with the paint portion first or the skip portion first.

The controller 200 then proceeds to step S26 and requests the operator to assign paint color and glass bead designations to the guns in the left and right matrix of guns. Through this procedure, controller 200 is informed as to which guns dispense paint, the color of the paint dispensed, and which guns dispense glass beads. Based on this information, controller 200 knows which painting guns to turn on during the painting operation to paint the appropriate color. Based on this information and the Installation data, controller 200 knows which guns to turn on to dispense glass beads and the delay distance necessary to align the dispensing of glass beads with freshly painted roadway.

In step S28, controller 200 requests that the operator enter the names of the operators and the vehicle driver. It is to be understood that this step is optional.

The controller 200 then proceeds to step S30, and requests that the operator enter the road number and mile marker where the painting operation is to begin. The Startup Data operation of controller 200 is then complete.

Next the Diagnostic mode of controller 200 will be described. The controller 200 in cooperation with optical I/O isolator 202, indicators 220 and indicator array 230, preferably LEDs, serve to indicate to an operator the malfunction of a paint or glass gun, a broken connection between controller 200 and optical I/O isolator 202, or a broken connection between optical I/O isolator 202 and a paint or glass gun. The optical I/O isolator 202 includes indicator array 230, preferably LEDs. It is to be understood that indicators 220 and indicator array 230 need not be LEDs, but can be any type of indicating device. The indicator array 230 includes an indicator corresponding to each relay port of optical I/O isolator 202. Each relay port transmits control signals received from controller 200 by optical I/O isolator 202 to a corresponding paint or glass gun. When optical I/O isolator 202 receives a control signal from controller 200, optical I/O isolator 202 lights the indicator of indicator array 230 which corresponds to the relay port from which the control signal will be output. Therefore, the indicators of indicator array 230 indicate receipt of control signals by optical I/O isolator 202. If an indicator of indicator array 230 fails to light, then an operator knows that either the optical I/O isolator 202 has malfunctioned or the connection between controller 200 and optical I/O isolator 202 is faulty.

The indicators 220 also correspond to each relay port of optical I/O isolator 202. The indicators 220, however, are connected to the conductor connecting the relay port of optical I/O isolator 202 and a corresponding paint or glass gun. Preferably, indicators 220 are connected to the conductor at the paint or glass gun end of the conductor. If an indicator of indicator array 230 corresponding to a relay port of optical I/O isolator 202 lights but the corresponding indicator 220 fails to light, then an operator knows that the connection between the optical I/O isolator 202 and a corresponding paint or glass gun is faulty. If both the indicator of indicator array 230 and indicator 220 lights but the corresponding paint or glass gun fails to dispense striping material, then the operator knows that the paint or glass gun is faulty.

When in the diagnostic mode of operation, controller 200 issues requests, via display 218, for the operator to enter a gun number. The controller 200 then outputs control signals to that numbered gun in each gun line. For instance, if the operator enters a gun number of two, then controller 200 outputs control signals to the second gun in each gun line. The operator can then monitor the corresponding indicators 230 of optical I/O isolator 202 and indicators 220 of console 204 to diagnose any malfunctions in the striping control system of the present invention.

In an alternative embodiment, controller 200 issues requests, via display 218, for the operator to enter a gun line and number of the gun within that line to send a control signal. The operator can then monitor the corresponding indicators 230 of optical I/O isolator 202 and indicators 220 of console 204 to diagnose any malfunctions in the striping control system of the present invention.

In a further alternative embodiment, the controller 200 can issue requests, via display 218, for the operator to enter the gun line to send control signals. The controller 200 then sends control signals to all the guns in that gun line. The operator can then monitor the corresponding indicators 230 of optical I/O isolator 202 and indicators 220 of console 204 to diagnose any malfunctions in the striping control system of the present invention.

Next, the Painting Control function of controller 200 will be described. In the Painting Control mode, controller 200 request via display 218 for the operator to choose either a semi-automatic mode of operation or an self-operating mode of operation. In the semi-automatic mode of operation, painting control is performed through operation of the command keys of keyboard 216 and optionally through the painting pattern command keys 226, auto/manual switch 224, skip/solid switch 232, and remote control 234 of the left control box 210 and right control box 212.

To begin painting in the semi-automatic mode, an operator moves the vehicle carrying the striping equipment to the location where the painting operation is to begin. When a left control box 210 and right control box 212 are provided, the operator can set the auto/manual switch 224 of the left control box 210 and right control box 212 to the manual setting, and control the striping operation with skip/solid switches 128 and remote controls 234. The control of the painting operation using the skip/solid switch 128 is the same as described above with respect to conventional striping control systems except for those differences noted above.

When the auto/manual switch 224 is set in the auto mode or the striping control system does not include a left control box 210 and right control box 212, the striping operation can be controlled through the use of command keys. Left control box 210 in FIG. 7 is only depicted as having painting pattern command keys 226, however, it is to be understood that the other command keys, which will be described with respect to keyboard 216, can also be included on left control box 210 and right control box 212. Furthermore, since the command keys of the left control box 210 and right control box 212 are the same as keyboard 216, a description of the command keys for the left control box 210 and right control box 212 will be omitted.

The operation of the controller 200 in response to activation of the command keys of keyboard 216 shown in FIG. 8 will now be described. The painting pattern command keys 226 of keyboard 216 correspond to a three gun line left matrix of guns and a three gun line right matrix of guns. It is to be understood, however, that the number of gun lines can be increased or decreased, with a corresponding change in the paint pattern command keys 226. For the operator's benefit, each painting pattern command key 226 depicts on its face the painting pattern created by the left, center and right gun line of the corresponding matrix of guns when the command key is activated. Taking painting pattern command key 228 for the left matrix of guns 140 as an example, the functions of controller 200 with respect to the activation of the painting pattern command keys 226 will be described.

The controller 200 performs control of the painting operation in conjunction with command key activation through the use of a painting pattern lookup table. Each painting pattern command key, when activated, instructs controller 200 to access a memory location of the lookup table. Each memory location of the lookup table stores a number of pointers corresponding to the number of gun lines in the matrix of guns to which the activated command key corresponds. Each pointer points controller 200 to one of the cycles stored by controller 200. The controller 200 then causes the gun line corresponding to the pointer to paint the cycle pointed to by the pointer. In the embodiment of FIG. 7, there are three gun lines in both the left matrix and right matrix of guns 140, 142. Therefore, each memory location of the lookup table stores three pointers.

When painting pattern command key 228 is activated, controller 200 accesses from the lookup table, pointers corresponding to the left, right, and center gun lines of the left matrix of guns 140. Each of the left, center, and right pointers points controller 200 to a cycle stored in controller 200. For instance, the left pointer corresponding to painting pattern command key 228 points controller 200 to access the first permanent cycle for creating a solid line. Similarly, the center pointer for painting pattern command key 228 points controller 200 to access the second permanent cycle for prohibiting painting by the center gun line. The right pointer for painting pattern command key 228 points controller 200 to an operator programmable cycle which, as illustrated on painting pattern command key 228, is a skipline. The controller 200 then outputs control signals to the left, center and right gun lines to paint the cycles pointed to by the left, center, and right pointer for painting pattern command key 228.

Since the painting pattern command keys correspond to painting patterns, different painting patterns can be selected during a painting operation by simply activating a different painting pattern command key.

The control of the paint and glass guns by controller 200 will now be described in detail with respect to FIG. 11. In the embodiment of the present invention, the controller 200 defaults to painting with white paint, and paints a cycle with the paint or skip portion first based on the startup data. The painting of the painting pattern is performed based on the distance indicated by the distance measuring device 114. When the controller begins to paint a cycle, the distance indicated by the distance measuring device is taken as the origin point in step S40. The controller 200 proceeds to step S56 and determines whether the paint portion of the cycle is zero. If the paint portion is zero, controller 200 proceeds to step S54. If the paint portion is not zero, the controller 200 turns on the paint guns which paint the appropriate color in step S42. The controller 200 monitors in step S44 the measured distance until the measured distance equals the origin point plus the glass bead gun delay. When the measured distance equals the origin point plus the glass bead gun delay, the controller 200 turns on the appropriate glass gun. In step S46, controller 200 monitors the measured distance to determine when the measured distance equals the origin point plus the paint portion of the cycle. When the measured distance equals the origin point plus the paint portion of the cycle, the controller 00 in step S48 turns off the paint guns turned on in step S42. In step S50, controller 200 monitors the measured distance to determine when the measured distance equals the origin point plus the paint portion of the cycle and the glass bead delay. When the measured distance equals the origin point plus the paint portion of the cycle and the glass bead delay, controller 200 in step S52 turns off the glass gun. In step S54, controller 200 monitors the measured distance to determine when the measured distance equals the origin point plus the paint portion plus the skip portion of the cycle. When the measured distance equals the origin point plus the paint portion plus the skip portion of the cycle, the painting of one cycle is complete and controller 200 returns to step S40 to continue painting the skipline.

The painting of a solid line and a blank line (no paint) are special cases of the above procedure. Since the cycle of a solid line has a paint portion which is infinity, the controller 200 never leaves step S46. Therefore, the gun line performing the painting does not turn off and a solid line is created. The opposite occurs with the painting of a blank line. The cycle of a blank line has no paint portion. The controller determines in step S56 that the paint portion is zero and then executes step S54. The skip portion, however, is infinite and controller 200 remains at step S54. Since step S42 is not executed, the paint guns are not turned on and a blank line remains.

The command keys of keyboard 216 include "ADV." and "RET." command keys for advancing and retarding the painting cycles of the operator programmable cycles used in the painting operation. The advance and retard operations are the same as described above with respect to the conventional striping control systems, therefore, a description thereof has been omitted.

The keyboard 216 also includes "+" and "–" command keys. When the "+" command key is activated, controller 200 increases the cycle length of the operator programmable cycles painted by each gun line by increasing the paint portion. When the "–" command key is activated, the controller 200 decreases the cycle length of the operator programmable cycles painted by the gun lines by decreasing the paint portion.

In an alternative embodiment, when the "+" command key is activated, controller 200 increases the paint portion of the operator programmable cycle while maintaining the cycle length. Likewise, when the "–" command key is activated, the controller 200 decreases the paint portion of each operator programmable cycle while maintaining the length of each cycle.

In a further alternative embodiment, when the "+" command key is activated, controller 200 increases the cycle length by increasing the skip portion. When the "–" command key is activated, controller 200 decreases the cycle length by decreasing the skip portion.

As shown in FIG. 8, a set of "ADV" "RET.", "+" and "–" command keys are provided for both the left matrix and right matrix of guns 140, 142. In the embodiment of the present invention, only one operator programmable cycle is used per painting pattern of the left matrix and right matrix of guns 140, 142; thus, only one "ADV.", "RET.", "+" and "–" command key per left matrix and right matrix of guns 140, 142 is needed. If more than one operator programmable cycle per painting pattern of a matrix of guns is used, it is to be understood that additional "ADV.", "RET.", "+" and "–" command keys corresponding to each operator programmable cycle can be added.

In the embodiment of the present invention shown in FIG. 8, keyboard 216 includes "W/Y" command keys. The controller 200 changes the color of paint dispensed from the gun lines based on the activation of the "W/Y" command key. When the gun lines are painting with white paint and the "W/Y" command key is activated, controller 200 stops painting with white paint and begins painting with yellow paint on the next cycle. Specifically, controller 200 turns off the guns in the gun lines which dispense white paint, and turns on the guns in the gun lines which dispense yellow paint on the next cycle. When the gun lines are painting with yellow paint and the "W/Y" command key is activated, the controller 200 stops painting with yellow paint and begins painting with white paint on the next cycle. Specifically, controller 200 turns off the guns in the gun lines which dispense yellow paint, and turns on the guns in the gun lines which dispense white paint on the next cycle. As shown in FIG. 8, keyboard 216 includes "W/Y" command keys for controlling the color of paint dispensed by the left matrix and right matrix of guns 140, 142. It is to be understood that "W/Y" command keys could be added so that each "W/Y" command key corresponds to each gun line.

In an alternate embodiment, when black paint is also used, the "W/Y" command key becomes a "B/W/Y" command key for switching between black, white and yellow paint. It is to be understood that while black, white and yellow paint are described for use with the present invention, any color of paint maybe used.

The keyboard 216 also includes a "paint first/skip first" command key. When a painting operation begins, the painting of various cycles must begin with either the paint portion or the skip portion. When cycles are painted beginning with the paint portion and an operator activates the "paint first/skip first" command key, the controller 200 stops painting cycles with the paint portion first and begins painting the cycles with the skip portion first on the next cycle. In other words, the measured distance is assumed to equal the origin point plus the paint portion of the operator programmable cycle being painted and controller 200 proceeds to step S48 when painting the next cycle. It is clear that the "paint first/skip first" command key does not affect the painting of a solid or blank line. Similarly, when the controller 200 instructs the striping guns to begin painting with the skip portion first and the operator activates the "paint first/skip first" command key, the controller 200 stops the painting of the cycles with the skip first and begins painting the cycles with the paint portion first on the next cycle.

The keyboard 216 includes "miles" and "time" command keys. When the "miles" command key is activated, the controller 200 displays on display 218 the speed of the vehicle and the volume of white paint, yellow paint, black paint (optional), and glass beads in the striping material storage tanks. The units of the vehicle speed depends on the units of distance used in calibrating the distance measuring device 114. It is to be understood that either english or metric units can be used. When the "time" command key is activated, the controller 200 displays on display 218 the date and time of day. The data displayed when the "time" and/or "miles" command keys are activated remains displayed on display 218. The displayed data, however, is not updated unless the operator again activates the "time" and/or "miles" command keys.

In an alternative embodiment, the data displayed on display 218, when the "time" and/or "miles" command keys are activated, can be continuously updated.

The keyboard 216 of the present invention also includes a "reset" command key corresponding to each of the left and right matrix of guns. When a "reset" command key is activated, the controller 200 halts the painting operation performed by the corresponding matrix of guns. Specifically, the controller 200 pauses the painting operation. When the operator deactivates the "reset" command key, the painting operation will begin where it left off. For instance, if a "reset" command key is activated during the painting of a cycle, upon deactivation of the "reset" command key the painting of the cycle is completed. The resumed painting of the cycle does not start by painting the cycle from the beginning, but from the point where painting of the cycle was halted.

Similarly, controller 200 pauses or halts the storage of monitored data and all monitored values are frozen until the reset command key is deactivated. Upon deactivation the monitoring of the monitored data begins where it left off.

The keyboard 216 includes an "end" command key corresponding to the left and right matrix of guns. When an "end" command key is depressed, the controller 200 ends the painting operation for the corresponding matrix of guns. When the painting operation for both the left and right matrix of guns ends, the controller enters the end procedure. In the end procedure, the operator receives a series of queries from controller 200 via display 218. The controller 200 asks the operator if the striping program should be downloaded to the external memory device 208. The controller 200 then downloads the striping program in response to an affirmative reply. The controller 200 then asks the operator if the monitored data should be printed by printer 206. The controller 200 then prints the monitored data out on printer 206 in response to an affirmative reply. The controller 200 then requests whether the monitored data should be downloaded to external storage device 208, and does so in response to an affirmative reply.

The creation and saving of the striping program will now be described in detail. Once the vehicle transporting the striping equipment is located at the starting point of the painting operation and the appropriate painting patterns have been selected, the painting operation begins when the vehicle begins to move. At this point the distance travelled is set to zero and subsequently incremented based on the output of the distance measuring device 114. When the painting operation begins, controller 200 stores the cycle states for each paint and glass gun and the measured distance. The cycle painted by a striping gun is referred to as the striping gun's cycle state. For instance, if the cycle which instructs the painting of a solid line is designated C1 (cycle 1), then controller 200 stores which striping guns received cycle C1.

When the cycle state of a striping gun changes, the controller 200 stores the new cycle state and the distance measured by distance measuring device when the change occurred. Therefore, the striping program is a sequential list of cycle state changes in order of the distance at which the changes occurred. The control of the painting operation by controller 200 is based on cycles whether the operator is using the command keys, skip/solid switches 232 in the auto mode, or skip/solid switches 232 and remote controls 234 in the manual mode. For instance, when the operator instructs the painting operation using the remote control 234, controller 200 saves the depression of the push button as the cycle for painting a solid line, and saves the cycle for painting a blank line when the push button is not depressed.

In the embodiment of the present invention, which utilizes distance measuring device 114, the controller 200 is able to store the cycle states at an accuracy of 0.01 feet.

When the painting operation ends with the activation of the "end" command key, construction of the striping program by controller 200 stops. If the operator indicates that the striping program should be downloaded to the external storage device 208, controller 200 downloads the following as a complete striping program to external storage device 208: the initialization data, the startup data, the permanent and operator programmable cycles, the painting pattern lookup table, and the striping program.

Next the self-operating mode of operation will be described. When an operator selects the self-operating painting operation mode, controller 200 inquires as to which of the striping programs saved on the memory element in the external storage memory device 208 to upload. Once the operator selects the striping program to upload, controller 200 replaces in its memory the following data uploaded from the external storage device 208: the initialization data, the startup data, the permanent and operator programmable cycles, and the painting pattern lookup table. The controller 200 then uploads the striping program When the upload is complete, the painting operation in accordance with the striping program begins when an operator hits any command key and the vehicle starts.

Figure 12:
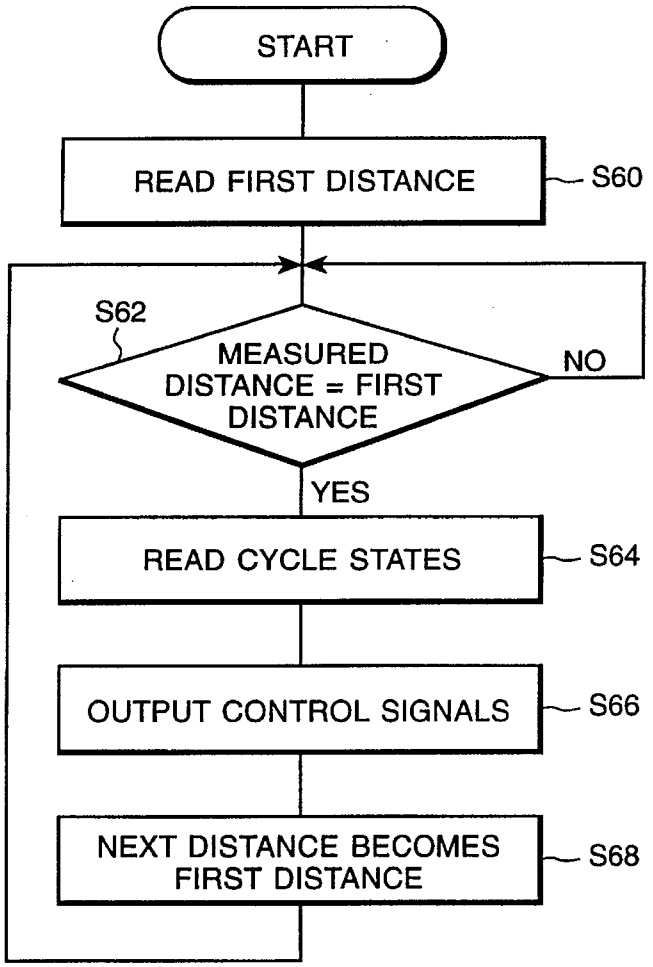
FIG. 12 is a flow chart of the operation of the controller of the present invention in accordance with a striping program.

The operation of controller 200 in accordance with the striping program will be described with reference to FIG. 12. In step S60, the controller 200 reads the first distance in the striping program, usually zero. The controller 200 then monitors, in step S62, the measured distance (set to zero at the beginning of the painting operation) to determine when the measured distance equals the first distance. When the measured distance equals the first distance, the controller 200 in step S64 reads the cycle states of the striping guns corresponding to the first distance. The controller 200 then in step S66 outputs control signals via optical I/O isolator 202 to the paint and glass guns so that the cycle states of the paint and glass guns equal the read cycle states. The next distance in the striping program then becomes the first distance in steps S68, and the process in FIG. 12 repeats. In this way, a previously recorded striping of the roadway can be restriped without the operator repeating all of the previous operator input.

An operator does not always start a painting operation in the self-operating mode at a point so that the painting operation exactly paints over the striped roadway. Additionally, changes affecting the distance measuring device 114 (i.e. tire pressure) can alter the alignment of the painting operation in the self-operating mode. Therefore, the "ADV." and "RET." command keys are rendered operable in the self-operating mode. An operator can use the "ADV." and "RET." command keys during the self-operating mode to align the painting operation with the striped roadway. In addition to or alternatively, the "+" and "–" command keys can be made operable during the self-operating mode.

Furthermore, a user can place the control system of the present invention on a vehicle without the striping equipment. Operators then drive the vehicle and operate the control system as they would if they were actually painting the roadway. In this manner a striping program can be created without performing the actual painting.

During the painting operation, whether it be in the semi-automatic or self-operating mode, the controller 200 monitors the volume of paint and glass beads in the paint and glass bead tanks. The controller 200 also monitors receipt of control signals by the striping guns. The controller 200 can then light indicators, such as indicators included in indicators 220, when the volume of paint or glass beads in a corresponding paint or glass bead tank falls below a predetermined level.

In addition to or instead of indicators 220, a sound producing device such as a speaker can be driven to signify the failure of a gun to dispense striping material or the low volume of paint or glass beads.

Figure 13:
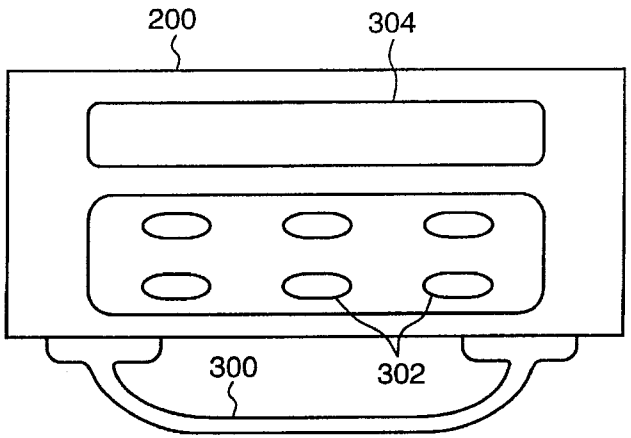
FIGS. 13 and 14 are block diagrams of the controller of the present invention with its inputs jumped to its outputs.

As an additional security measure, controller 200 can perform self diagnoses to determine whether it is functioning properly. The self diagnostic function requires that an operator connect a jumper 300 as shown in FIG. 13 to controller 200 so that the inputs of controller 200 are connected to the outputs of controller 200. Generally the number of inputs does not equal the number of outputs, so more than one input or more than one output will be connected to an output or input, respectively.

Upon connecting the jumper 300 to controller 200, the operator, using control keys 302 on controller 200, causes the first stage of the diagnostic routine to initiate. In the first stage, controller 200 sends a test signal on each of its outputs, and monitor its inputs for the receipt of a control signal. The controller 200 outputs on display 304 which inputs and outputs functioned properly and which inputs and outputs appeared not to function properly.

The controller 200 determines that an output is functioning properly if at least one input connected thereto indicates receipt of a control signal. The controller 200 determines that an output might not be functioning properly if none of the inputs connected thereto indicate receipt of a control signal. The controller 200 determines that an input is functioning properly if the input indicates receipt of a control signal. The controller 200 determines that an input might not be functioning properly if it fails to indicate the receipt of a control signal.

Figure 14:
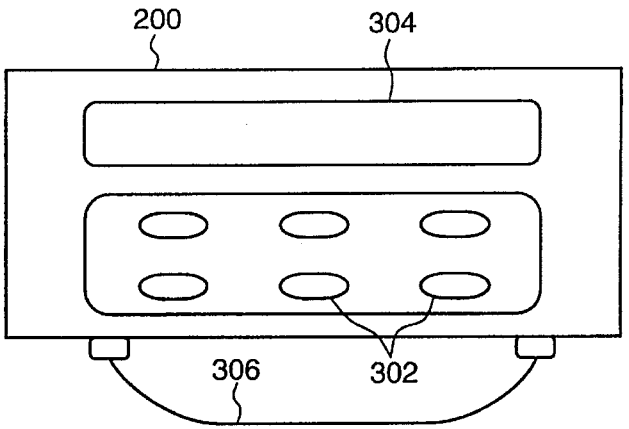

In the second stage of the diagnostic function, the operator disconnects jumper 300. In the second stage, the operator uses a jumper 306 which connects a single input to a single output as shown in FIG. 14. The operator then tests each output which might not be functioning properly by connecting jumper 306 to one such output and to an input known to be functioning properly. The operator then instructs controller 200, via control keys 302, to output a control signal on the output connected to jumper 306. If the input connected to jumper 306 indicates receipt of a control signal, then the output connected to jumper 306 is functioning properly. If, however, the input connected to jumper 306 does not indicate receipt of a control signal, the output connected to jumper 306 is not functioning properly. The operator performs this test for each output which might not be functioning properly.

The inputs which appeared not to function properly are tested in a similar fashion by connecting jumper 306 to such an input and to an output known to be functioning properly. The operator then instructs controller 200, via control keys 302, to output a control signal on the output connected to jumper 306. If the input connected to jumper 306 indicates receipt of a control signal, then the input is functioning properly. If, however, the input connected to jumper 306 does not indicate the receipt of a control signal, the input is not functioning properly. The operator performs this test for each input which might not be functioning properly.

While the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

I claim:

1. A road striping control system for controlling and learning a painting operation of road striping equipment mounted on a vehicle, said painting operation comprising paint striping commands as a function of a location of said vehicle, the control system comprising:

a control panel having controls on which operator input relating to the painting operation is received;

a memory unit for storing striping programs; and a processor connected to the control panel and to the memory unit, the processor programmed to:

receive operator input from the control panel; and when in a learning phase, (a) determine, based on the received operator input and on a location of the road striping equipment on a road, striping commands for instructing the control of the road striping equipment; and (b) store the striping commands as a striping program in the memory unit; and when in a painting phase, control the road striping equipment to perform the painting operation based on at least one of:

(i) the received operator input, and (ii) a striping program stored in the memory unit.

2. A control system as in claim 1, wherein the processor is programmed to perform in the learning phase and in the painting phase simultaneously.

3. A control system as in claim 1, wherein the processor is programmed to perform in the learning phase and then to perform in the painting phase.

4. A control system as in claim 1, wherein the processor is programmed to perform in combinations of the learning phase and the painting phase.

5. A control system as in claim 1, wherein the processor is programmed to perform in at least one of:

(a) the learning phase and the painting phase simultaneously;

(b) the learning phase and then the painting phase; and (c) combinations of the learning phase and the painting phase.

6. A control system as in claim 1, wherein the control system is separate from the road striping equipment, and wherein the learning phase operations take place prior to the painting phase operations.

7. A control system as in claim 6, wherein the control system is mounted on a vehicle separate from the road striping equipment.

8. A control system as in claim 1, wherein the processor is further programmed to, when in the painting phase, control the road striping equipment to perform the painting operation based on selected striping commands stored in the memory unit.

9. A control system as in claim 8, wherein said selected striping commands are selected based on a desired location on the road.

10. A control system as in claim 1, wherein selected portions of a stored painting operation can be replaced.

11. A control system as in claim 1, further comprising an external storage unit for storing a striping program stored by the memory unit.

12. A control system as in claim 1, further comprising:

means for measuring the distance travelled by the vehicle; and wherein the memory unit stores the striping commands as a function of the measured distance.

* * * * *